US007238059B1

(12) United States Patent
Wu

(10) Patent No.: US 7,238,059 B1
(45) Date of Patent: Jul. 3, 2007

(54) AUDIO JACK CONNECTOR

(75) Inventor: Yin-Lung Wu, Tu-Cheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/447,122

(22) Filed: Jun. 6, 2006

(51) Int. Cl.
*H01R 24/04* (2006.01)

(52) U.S. Cl. ..... 439/668

(58) Field of Classification Search ..... 439/668, 439/669

See application file for complete search history.

(56) References Cited

U.S. PATENT DOCUMENTS

| | | | | |
|---|---|---|---|---|
| 5,919,052 | A * | 7/1999 | Ho | 439/83 |
| 6,220,898 | B1 * | 4/2001 | Wu | 439/668 |
| 6,224,409 | B1 * | 5/2001 | Chang | 439/188 |
| 6,312,274 | B1 * | 11/2001 | Lin | 439/188 |
| 6,319,030 | B1 * | 11/2001 | Wu | 439/188 |
| 6,368,156 | B1 * | 4/2002 | Lin | 439/668 |
| 6,478,629 | B1 * | 11/2002 | Li et al. | 439/668 |
| 6,575,793 | B1 * | 6/2003 | Li et al. | 439/668 |
| 6,592,408 | B2 * | 7/2003 | Ma et al. | 439/669 |
| 6,595,804 | B2 * | 7/2003 | Nagata | 439/668 |
| 6,690,801 | B2 * | 2/2004 | Yeh | 381/77 |
| 6,869,315 | B2 * | 3/2005 | Nakai et al. | 439/668 |
| 6,887,111 | B2 * | 5/2005 | Nakai et al. | 439/669 |
| 6,964,586 | B2 * | 11/2005 | Siddiqui | 439/669 |
| 7,033,226 | B1 * | 4/2006 | Chien et al. | 439/668 |
| 7,101,230 | B2 * | 9/2006 | Ma | 439/668 |
| 2002/0052148 | A1 * | 5/2002 | Nagata | 439/668 |
| 2002/0193006 | A1 * | 12/2002 | Ma et al. | 439/669 |
| 2003/0045173 | A1 * | 3/2003 | Zhang et al. | 439/668 |
| 2003/0100227 | A1 * | 5/2003 | Yeh | 439/668 |
| 2003/0119368 | A1 * | 6/2003 | Li et al. | 439/668 |
| 2003/0119369 | A1 * | 6/2003 | Nakai et al. | 439/669 |
| 2004/0038593 | A1 * | 2/2004 | Siddiqui | 439/668 |
| 2004/0242076 | A1 * | 12/2004 | Nakai et al. | 439/668 |
| 2006/0009082 | A1 * | 1/2006 | Lin | 439/668 |
| 2006/0089054 | A1 * | 4/2006 | Woo | 439/668 |

* cited by examiner

*Primary Examiner*—Ross Gushi
(74) *Attorney, Agent, or Firm*—Rosenberg, Klein & Lee

(57) ABSTRACT

An audio jack connector includes an insulating housing and a first set and a second set of conductive contacts. A plurality of recesses is provided in the insulating housing. Each contact has a fixing portion, a contacting portion and an elastic compressing portion. The first and second sets of conductive contacts are received in the plurality of recesses, the elastic compressing portions of the first set of conductive contacts is located at a middle position of a lateral wall of the insulating housing; the elastic compressing portions of the second set of conductive contacts are located at a middle position of the opposite laterally wall of the insulating housing. While the audio jack connector is assembled with an external printed circuit board having a gap, the audio jack connector embedded into the gap, so the assembly height of the audio jack connector is reduced.

7 Claims, 4 Drawing Sheets

AUDIO JACK CONNECTOR

BACKGROUND OF THE INVENTION

1. Field of the Invention

The present invention relates to a connector, and more particularly, relates to an audio jack connector.

2. The Related Art

An audio jack connector is widely used in electronic devices for transmitting audio signals. A conventional audio jack connector includes a plastic housing and a plurality of contacts. The plastic housing has a receiving cavity for receiving a complementary plug connector. Pluralities of recesses, which extend through the receiving cavity, are provided in the plastic housing. Each contact has a contacting portion and a soldering portion. The contacts are received in the recesses, and the contacting portions are revealed in the receiving cavity for electrically connecting the complementary plug while the soldering portions is soldered to an external printed circuit board (PCB).

However, the contacts of the conventional audio jack connector as described above soldered to the external printed circuit board are easy to be loosen, and such disengagement may affect audio signals transmission.

To solve the above question, Taiwan patent No. 474500 issued on Jan. 21, 2002 discloses an audio jack connector having elastic compressing structures so as to electrically connect with an external printed circuit board by the compressing contacting members. The audio jack connector includes an insulating body, a set of contacts and an adapting member. Each of the contacts includes a contacting portion and an elastic compressing portion. The set of contacts are received in the insulating housing, and the contacting portions electrically contact with the complementary plug connector while the elastic compressing portion are elastically compressed and contacted with the external PCB.

As described above, the assembling height of the disclosed audio jack connector in Taiwan Patent No. 474500 can be appropriately adjusted by adjusting the elastic compression portions of the contacts while the audio jack connector assembled in an electronic device. However, the audio jack connector is assembled above the external printed circuit board, the assembling height of audio jack connector cannot be further reduced while assembling and therefore occupies the interior space of the electronic device.

SUMMARY OF THE INVENTION

It is therefore an object of the present invention to provide an audio jack connector capable of reducing assembling height thus to save the interior space of the electronic device.

To achieve the object, an audio jack connector includes an insulating housing and a first set and a second set of conductive contacts. The insulating housing has a mating wall, a rear wall opposite to the mating wall and a top wall, a receiving cavity communicating with the mating wall and the rear wall. A plurality of recesses is provided in the insulating housing, each of the recesses extending through the receiving cavity. Each of the contacts has a fixing portion, a contacting portion extending from one end of the conductive contact and an elastic compressing portion extending from another end of the conductive contact. The first and second sets of conductive contacts are inserted into the plurality of recesses. The contacting portions of the first of the first set of conductive contacts are protruded in the receiving cavity, the elastic compressing portions thereof protrude upwardly from the top wall and further extend outwardly from a lateral wall, and the tails of the elastic compressing portion of the first set of conductive contacts are located at a middle position of the lateral wall. The contacting portions of the second set of the conductive contacts are protruded in the receiving cavity, the elastic compressing portions thereof protrude upwardly from the top wall and further extend outwardly from an opposite lateral wall, and the tails of the elastic compressing portions of the second set of conductive contacts are located at a middle position of the opposite lateral wall.

As described above, because of that the audio jack connector assembled with an external printed circuit board, the printed circuit board is cut a gap, and the audio jack connector is embedded into the gap, the assembly height of the audio jack connector is therefore reduced. Furthermore, the elastic compressing portions of the contacts can be adjusted to adopt the assembling space and thus stably contact with the printed circuit board.

The above-mentioned and other features and objects of this invention and the manner of attaining them will become more apparent and the invention itself will be better understood by reference to the following description of a preferred embodiment of the invention taken in conjunction with the accompanying figures wherein:

DETAILED DESCRIPTION OF THE PREFERRED EMBODIMENT

Figure 1:
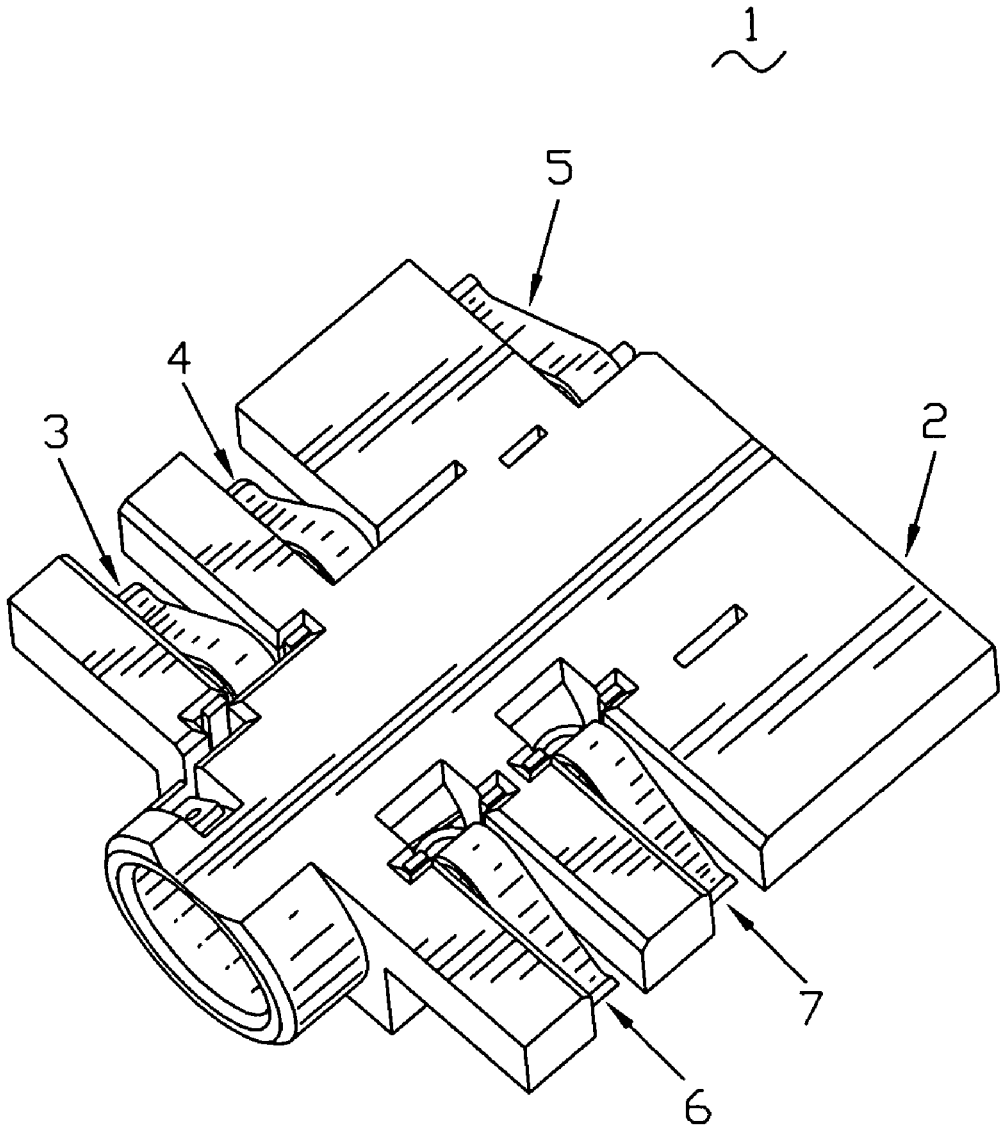
FIG. 1 is a perspective view of an audio jack connector according to the prevent invention.

Referring to FIG. 1, an audio jack connector 1 mating with a complementary plug connector for transmitting audio signals is shown. The audio jack connector 1 includes an insulating housing 2 and a first set of conductive contacts 3, 4, 5, and a second set of conductive contacts 6, 7 being inserted in the insulating housing 2.

Figure 2:
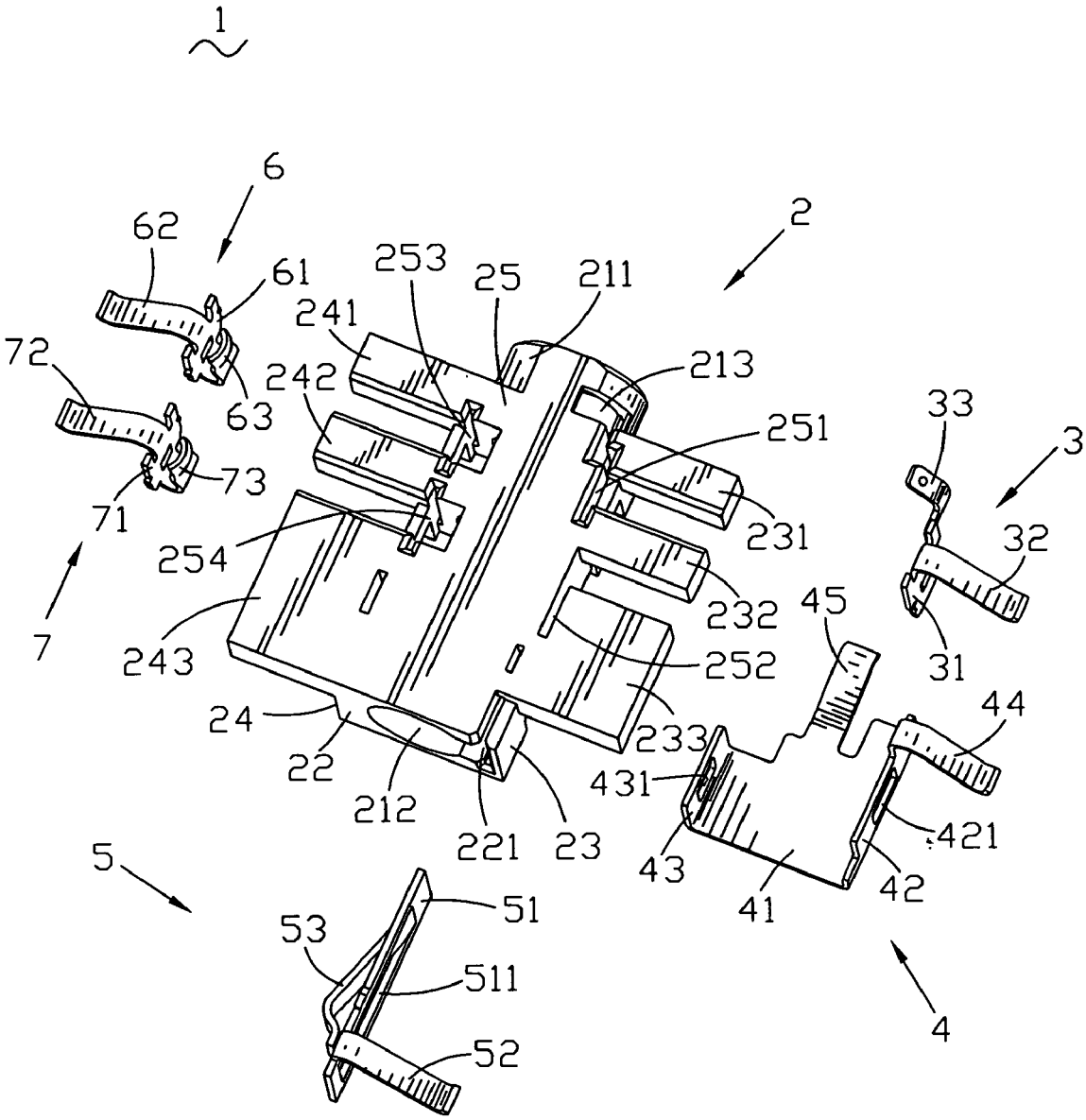
FIG. 2 is an exploded perspective view of the audio jack connector as shown in FIG. 1.
Figure 3:
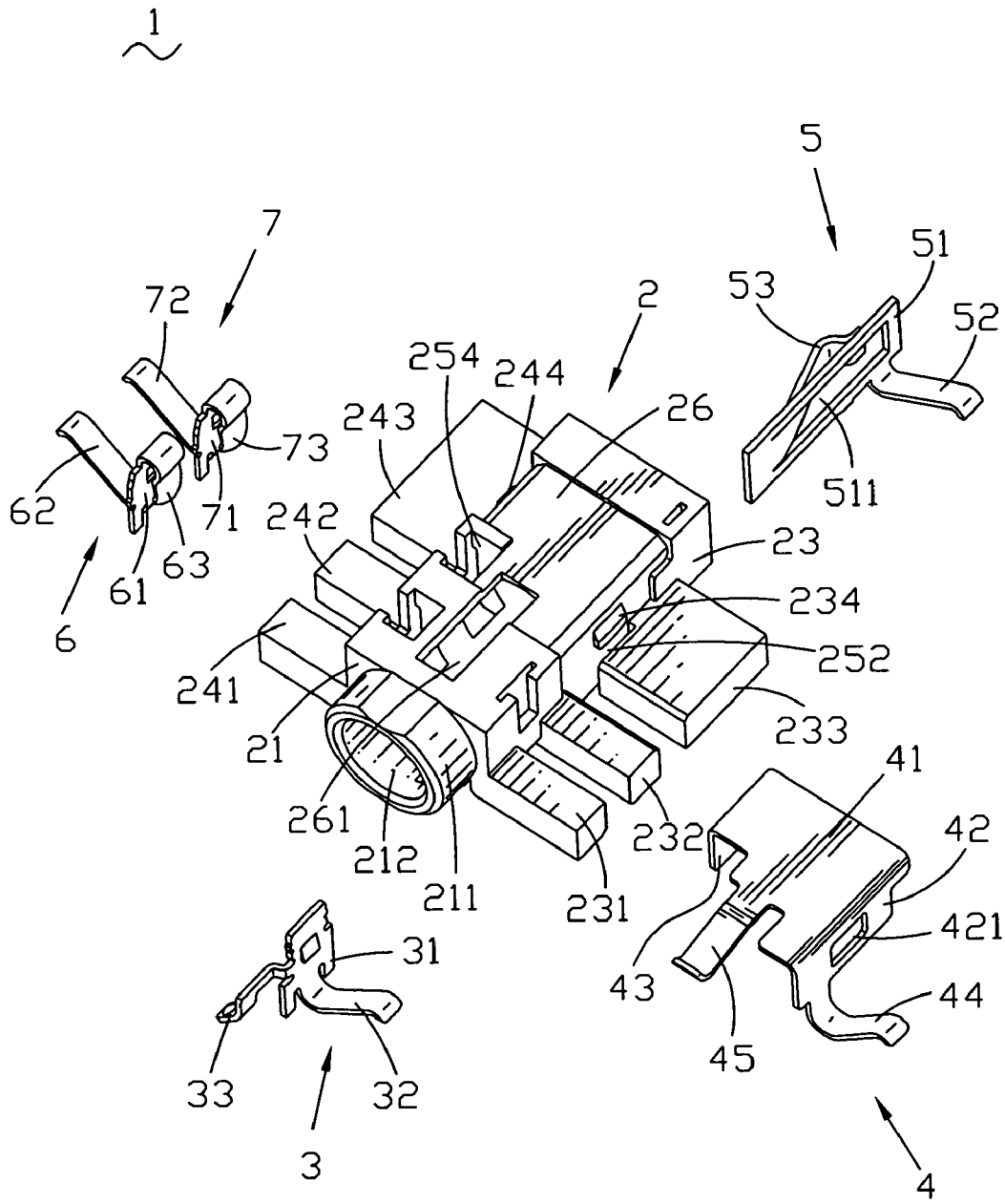
FIG. 3 is another exploded perspective view of the audio jack connector as shown in FIG. 1.

Referring to FIG. 2 and FIG. 3, the insulating housing 2 has a mating wall 21, a rear wall 22 opposite to the mating wall 21, a top wall 25, two lateral walls 23, 24 extending downwardly from two lateral sides of the tope wall 25, and a bottom wall 26 opposite to the top wall 25. The insulating housing 2 is a rectangular structure body. Two lateral sides of the top wall 25 stretch outwardly to form a plurality of rectangular left wings 231, 232, 233 and right wings 241, 242, 243. The two lateral walls 23, 24 are located below the left wings 231, 232, 233 and right wings 241, 242, 243. A top face of each wing 231, 232, 233, 241, 242, 243 is flush with the top wall 25 of the insulating housing 2. The left wings 231, 232, 233 and the right wings 241, 242, 243 separate from each other to form predetermined spaced intervals. The left wings 231, 232 are rectangular boards, and a front face of the left wing 231 is flush with the mating wall 21. The left wing 233 is a rectangular board. A rear face of the left wing 233 is placed away from the real wall 22 at a predetermined distance. The right wings 241, 242 are rectangular, and a front face of the right wing 241 is flush with the mating wall 21. The right wing 243 is a rectangular board, and a rear face of the right wing 243 is flush with the rear wall 22. The mating wall 21 of the insulating housing 2 protrudes forward to form a cylindrical mating portion 211. A receiving cavity 212 extends from the mating portion 211 through the front wall 21 to the rear wall 22. An outer surface of the mating portion 211 adjacent to the top wall 25 cut downwardly through the receiving cavity 212 to provide a narrow slot 213. A first recess 251 is provided in a front portion of the top wall 25 adjacent to the mating portion 211. The first recess 251 extends downwardly from the top wall 25 and the front portion of the first recess 251 extends forwardly to connect with the narrow slot 213. A front portion of the left wing 233 cut through from the top face of left wing 233 to form a cutout 252 being adjacent to the left wall 23. A second recess 261 is provided in the bottom wall 26 with longitudinal configuration. The second recess 261 extends upwardly through the receiving cavity 212 and extends longitudinally along the bottom face 26 being a longitudinal rectangle recess. A third recess 221 cuts forward through a left portion of the rear wall 22 of the top wall 25 and connects with the receiving cavity 212. A right portion of the top wall 25 penetrates downwardly through the bottom wall 26 to provide a fourth recess 253 and a fifth recess 254 which is spaced away from the fourth recess 253. The fourth recess 253 is located in the spaced intervals between the right wings 241, 242, while the fifth recess is located in the spaced intervals between the right wings 242, 243. The fourth recess 253 and the fifth recess 254 extend inwardly to connect with the receiving cavity 212. Two latching lumps 234, 244 are protruded from middle portions of the two lateral walls 23, 24 of the insulating housing 2, and the two latching lumps 234, 244 are respectively located below the left wing 233 and the right wing 244, as shown in FIG. 3.

The plurality of conductive contacts 3, 4, 5, 6, 7 is inserted in the insulating housing 2 to electrically contact with the complementary plug connector so as to be capable of transmitting audio signals, and the plurality conductive contacts consist of a first conductive contact 3, a second conductive contact 4, a third conductive contact 5, a fourth conductive contact 6 and a fifth conductive contact 7.

The first conductive contact 3 has a first fixing portion 31, an upper portion of the first fixing portion 31 bends outwardly to form a first elastic compressing portion 32, the tail of the first elastic compressing portion 32 bend downwardly to be an arc shape. A front end of the first fixing portion 31 extends upwardly to be a first contacting portion 33 with an arc shape. Two lateral sides of the first fixing portion 31 protrude upwardly to shape stabs for fixing the first conductive contact 3 to the insulating housing 2.

The second conductive contact 4 has a second fixing portion 41. The fixing portion 41 is a board so as to be securely fixed to the bottom wall 26. Two lateral sides of the second fixing portion 41 extending vertically to form two rectangular lateral tabs 42, 43. The two lateral tabs 42, 43 respectively cut through to form two rectangular fixing holes 421, 431. A upper edge of the lateral tab 43 bends outwardly to form a second elastic compressing portion 44, and the tail of the second elastic compressing portion 44 bend upwardly like an arced structure. A front portion of the second fixing portion 41 extends forwardly to form a second contacting portion 45 having an arced construction at the tip end.

The third conductive contact 5 has a rectangular third fixing portion 51. An upper edge of the third fixing portion 51 extends outwardly to shape a third elastic compressing portion 52 and the tail of the third elastic compressing portion 52 bends downwardly to be an arc shape. The third fixing portion 51 is cut through to form a through hole 511 and thus inwardly protrude an arcuate third contacting portion 53.

The fourth conductive contact 6 has a fourth fixing portion 61. An upper portion of the fourth fixing portion 61 bents outwardly and extends to form a fourth elastic compressing portion 62, and the tail of the fourth compressing portion 62 bends upwardly to be an arc structure. A lower portion of the fourth elastic compressing portion 62 bends upwardly to form a fourth contacting portion 63, two lateral edges of the upper portion of the fourth fixing portion 61 protrudes two stabs so as to fixing the fourth conductive contact 6 to the insulating housing 2.

The fifth conductive contact 7 has the same structure to the forth conductive contact 6. The fifth conductive contact 7 has a fifth fixing portion 71. An upper portion of the fifth fixing portion 71 bends outwardly to form a fifth elastic compressing portion 72 and an lower portion of the fifth fixing portion 72 bends upwardly to form a fifth contacting portion 73.

Figure 4:
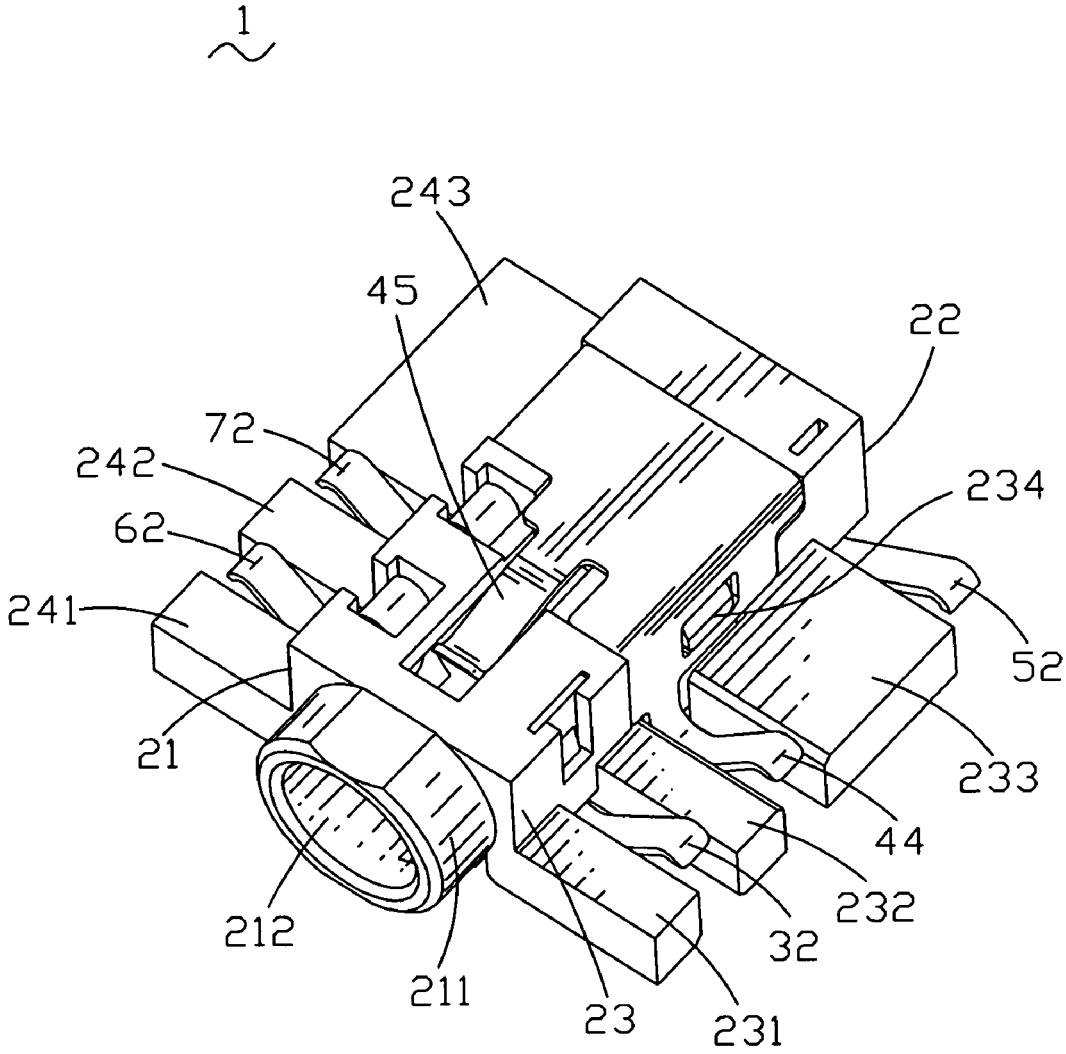
FIG. 4 is another perspective view of the audio jack connector.

Referring to FIG. 1 and FIG. 4, during assembling, the first fixing portion 31 of the first conductive contact 3 is inserted into first recess 251, and the two stabs of the first fixing portion 31 would fix the first conductive contact 3 securely. When the first contacting portion 33 is inserted forwardly into the narrow slot 213 along first recess 251, the first contacting portion 33 is protruded in the receiving cavity 212 of the mating portion 211. The first elastic compressing portion 32 protrudes upwardly from the top wall 25 and extends outwardly from the left lateral wall 23. The first elastic compressing portion 32 is located in the spaced interval between the left wings 231 232. The tail of the first elastic compressing portion 32 is located at a middle position of the left lateral wall 23 below the left wings 231, 232. The second fixing portion 41 of the second conductive contact 4 is fixed to the rear portion of the bottom wall 26, the two fixing holes 421, 431 of the two lateral tabs 42, 43 are respectively latched with the latching lumps 234, 244 so as to fix the second conductive contact 4 to the insulating housing 2. The second contacting portion 45 is received in the second recess 261 and protrudes into the receiving cavity 212. A rear portion of the lateral tab 42 is inserted into the cutout 252, and the second elastic compressing portion 44 passes through the cutout 252 to protrude upwardly from the top wall 25 and further to extend outwardly from the left lateral wall 23. The second elastic compressing portion 44 is located between the spaced interval between the left wings 232, 233. The tail of the second elastic compressing portion 44 located at the middle position of the left wall 23 below bottom surfaces of the left wings 232, 233. The third fixing portion 51 is inserted into the third recess 221, and the third contacting portion 53 is protruded in the receiving cavity 212. The third elastic compressing portion 52 protrudes upwardly from the top wall 25 and extends outwardly from the left lateral wall 23. The third elastic compressing portion 52 is placed behind the left wing 233 with a distance away from the rear wall 22, and the tail of the third elastic compressing portion 52 is located at the middle position of the left lateral wall 23 below the bottom surface of the left wing 233. The fourth and fifth fixing portion 61,71 are respectively fixed into the fourth and fifth recesses 253, 254, the contacting portions 63, 73 are respectively protruded in the receiving cavity 212. The fourth and fifth elastic compressing portions 62, 72 respectively extend upwardly from the top wall 25 and further extend outwardly from the right lateral wall 24, the fourth elastic compressing portion 63 is located in the spaced interval between the right wings 241, 242. The fifth elastic compressing portion 73 is located in the spaced interval between the right wings 242, 243. The tails of the fourth and fifth elastic compressing portions 62, 72 are located at the middle position of the right wall 24 below the bottom surfaces of the right wings 241, 242, 243.

The printed circuit board is cut a rectangular gap corresponding to the profile structure of the insulating housing 2 for matching the audio jack connector 1. Therefore, the insulating housing 2 is embedded into rectangular gap, as the tails of the first, second, and third elastic compressing portions 32, 44, 52 are located at the middle position of the left wall 24 of the insulating housing 2, the tails of fourth and fifth elastic compressing portions 62, 72 are located at the middle position of the right wall 24, the bottom surfaces of the first, second, third, fourth and fifth elastic compressing portions 32, 44, 52, 62, 72 abut against a top surface of the external printed circuit board and elastically deform upwardly so as to be flush with the bottom surfaces of the left wings 231, 232, 233 and the right wings 241, 242, 243. The bottom surfaces of the tails of the first, second, third, fourth and fifth elastic compressing portions 32, 44, 52, 62, 72 contact with the contacting pads of the external printed circuit board so as to electrically connect with the printed circuit board. While the elastic compressing portions 32, 44, 52, 62, 72 are electrically contacting with the printed circuit board, the bottom surfaces of the left wings 231, 232, 233 and the right wings 241, 242, 243 are respectively abut against the external printed circuit board so as to sustain external pressing forces while the audio jack connector 1 are pressed by external pressing forces.

While the audio jack connector 1 is mated with an complementary plug connector, the complementary plug is inserted into the receiving cavity 212 to electrically contact with the first, second, third, fourth and fifth contacting portions 33, 45, 53, 63, 73 which protrude in the receiving cavity 212, so the audio jack connector 1 is electrically connected with the complementary plug connector for transmitting audio signals.

As described above, the elastic compressing portions 32, 44, 52, 62, 72 of the conductive contacts 3, 4, 5, 6, 7 are respectively extending outwardly from the top wall of the insulating housing 2, and the tails of the elastic compressing portions 32, 44, 52, 62, 72 are located at the middle portions of the two lateral walls 23, 24 of the insulating housing 2 below the left and right wings 231, 232, 233, 241, 242, 243, and further to be elastically compressed on the external printed circuit board. The insulating housing 2 is embedded into the gap of the external printed circuit board, the lower portions of the insulating housing 2 is submerged under the printed circuit board, therefore, the assembling height of the audio jack connector 1 is highly reduced. Furthermore, it saves interior space of an electronic device in which the audio jack connector 1 is assembled, and it is advantageous of miniaturization for the electronic device.

Accordingly, there has been disclosed an audio jack connector. While an illustrated embodiment of this invention has been disclosed herein, it is understood that various modifications and adaptations to the disclosed embodiment are possible, and it is intended that this invention be limited only by the scope of the appended claims.

What is claimed is:

1. An audio jack connector comprising:

an insulating housing having a mating wall, a rear wall opposite to the mating wall, two lateral walls and a top wall, a receiving cavity communicating with the mating wall and the rear wall, a plurality of recesses being provided in the insulating housing, each of the recesses extending through the receiving cavity;

a first set of conductive contacts, each of the conductive contacts having a fixing portion, a contacting portion extending from one end of the fixing portion and an elastic compressing portion extending from the other end of the fixing portion; and a second set of conductive contacts, each of the conductive contacts having a fixing portion, a contacting portion extending from one end of the fixing portion and an elastic compressing portion extending from the other end of the fixing portion;

wherein the first and second set of conductive contacts are inserted into the plurality of recesses, the contacting portions of the first set of conductive contacts are protruded in the receiving cavity, the elastic compressing portions thereof protrude upwardly from the top wall and further extend outwardly from a lateral wall, and the tails of the elastic compressing portion of the first set of conductive contacts are located at a middle position of the lateral wall, the contacting portions of the second set of the conductive contacts are protruded in the receiving cavity, the elastic compressing portions thereof protrude upwardly from the top wall and further extend outwardly from the opposite lateral wall, and the tails of the elastic compressing portions of the second set of conductive contacts are located at a middle position of the opposite lateral wall.

2. The audio jack connector as claimed in claim 1, wherein two lateral walls of the top wall stretch outwardly to form a plurality of wings, a top face of each wing being flush with the top wall of the insulating housing, the wings being separated from each other to form a plurality of spaced intervals, the elastic compression portions of the first set and the second set of conductive contacts being respectively located in the spaced intervals.

3. The audio jack connector as claimed in claim 1, wherein the first set of conductive contacts comprising a first conductive contact, a second conductive contact, and a third conductive contact, the second set of conductive contacts comprising a fourth conductive contact and a fifth conductive contact, the plurality of recesses comprising a first recess, a second recess, a third recess, a fourth recess and a fifth recess, the first recess being provided in a lateral portion of the top wall of the insulating housing, the second recess being provided in a bottom wall opposite to the top wall, the third recess cutting forward through the rear wall, and the fourth recess being provided in the opposite lateral portion of the top wall of the insulating housing, the fifth recess being spaced away from the fourth recess, the first conductive contact, the second conductive contact, the third conductive contact, the fourth conductive contact and the fifth conductive contact being respectively inserted in the first recess, the second recess, the third recess, the fourth recess and the fifth recess.

4. The audio jack connector as claimed in claim 3, wherein the fixing portion of the first conductive contact extending upwardly to form a first elastic compression portion and extending forwardly to form a first contacting portion, two lateral sides of the fixing portion of the second conductive contact extending upwardly to form two lateral tabs, a lateral tab bending outwardly to form a second elastic compressing portion, a front portion of the fixing portion of the second conductive contact extending forwardly to form a second contacting portion, the fixing portion of the third conductive contact protruding inwardly to form a third contacting portion, an upper edge of the fixing portion of the third conductive contact extending outwardly to form a third elastic compressing portion, the fixing portion of the fourth conductive contact extending outwardly to form a fourth contacting portion and lower portion of the fixing portion bending upwardly to form a fourth elastic compressing portion, the fixing portion of the fifth conductive contact extending outwardly to form a fifth contacting portion and lower portion of the fixing portion bending upwardly to form a fifth elastic compressing portion.

5. The audio jack connector as claimed in claim 3, wherein the top wall of the insulating housing stretching outwardly to form a plurality of wings, a top face of each wing being flush with the top wall of the insulating housing, the wings being separated from each other to form spaced intervals, the elastic compressing portions of the first, the second, the fourth and the fifth conductive contacts being respectively located in the spaced intervals.

6. The audio jack connector as claimed in claim 3, wherein the insulating housing protrudes forwardly to form a mating portion, an outer surface of the mating portion adjacent to the top wall cutting downwardly through the receiving cavity to provide a narrow slot, the fixing recess extending forwardly to connect with the narrow slot, the fixing portion of the first conductive contact bending curvedly to form the contacting portion located at the slot and protruding outwardly in the receiving cavity.

7. The audio jack connector as claimed in claim 3, wherein two lateral sides of the fixing portion of the second conductive contact extending upwardly to form two lateral tabs, two latching holes being respectively provided in the two lateral tabs, two lateral walls of the insulating housing protruding two latching lumps to respectively latching with the two lathing holes.

* * * * *